United States Patent [19]

Maffei

[11] Patent Number: 4,858,564

[45] Date of Patent: Aug. 22, 1989

[54] FEEDWATER HEATER WITH IMPROVED STEAM DISTRIBUTION

[75] Inventor: Charles V. Maffei, Elizabeth, N.J.

[73] Assignee: Foster Wheeler Energy Corporation, Clinton, N.J.

[21] Appl. No.: 194,243

[22] Filed: May 16, 1988

[51] Int. Cl.[4] ..... F22D 1/28; F22D 1/32; F22D 1/40

[52] U.S. Cl. ..... 122/441; 165/114

[58] Field of Search ..... 122/441, 442; 165/114

[56] References Cited

U.S. PATENT DOCUMENTS

| | | | |
|---|---|---|---|
| 3,938,588 | 2/1976 | Eit et al. | 122/441 X |
| 4,084,546 | 4/1978 | Schneeberger et al. . | |
| 4,254,825 | 3/1981 | Imazu | 122/441 X |
| 4,461,346 | 7/1984 | Hoshino et al. . | |
| 4,541,366 | 9/1985 | Lamb et al. | 122/441 |

*Primary Examiner*—Edward G. Favors

*Attorney, Agent, or Firm*—Marvin A. Naigur; Kice, Warren B.

[57] ABSTRACT

A feedwater heater in which a bundle of tubes is disposed in a vessel in the flow path of steam through the vessel. Feedwater is introduced into the tubes for passing in a heat exchange relation with the steam to condense at least a portion of the steam and to add heat to the feedwater. An impingement plate is disposed immediately below the inlet in the flow path for deflecting the steam in a direction transverse to the direction of flow of the steam, and at least one vane is disposed in the vessel in the path of the deflected steam for distributing steam more uniformly throughout the tube bundle.

1 Claim, 1 Drawing Sheet

FEEDWATER HEATER WITH IMPROVED STEAM DISTRIBUTION

BACKGROUND OF THE INVENTION

This invention relates to a feedwater heater and, more particularly, to such a heater in which there is an improved distribution of steam at the inlet area of the tube bundle in the desuperheat zone of the heater.

Feedwater heaters are traditionally used to pass steam in thermal contact with feedwater in order to condense the steam and raise the temperature of the feedwater. A typical feedwater heater contains a multiplicity of U-shaped water tubes which extend from a feedwater inlet to a feedwater outlet over which the steam is passed to affect the heat exchange. However, it has been discovered that tube failures often occur in the area where the steam enters the tube bundle, largely due to an uneven distribution of the steam across the tube bundle after it enters the heater. This is largely due to the momentum of the moving steam and the sudden changes in direction of the steam in this area which causes a large portion of the steam flow to concentrate at extreme areas with a greater degree of turbulence. This, in turn, sets up conditions that result in tube vibration and erosion, especially if moist steam conditions exist. As a result, tube fatigue failures occur along with abrasion/impact necking at the baffle supports.

SUMMARY OF THE INVENTION

It is therefore an object of the present invention to provide a feedwater heater which allows an improved distribution of steam into the interior of the heater for heat exchange with the feedwater.

It is a more specific object of the present invention to provide at least one deflector vane strategically disposed in the interior of the heater to cause a better distribution of the steam in selected areas of the heater.

It is a further object of the present invention to provide a feedwater heater of the above type which minimizes tube failures, vibrations and erosion.

Towards the fulfillment of these and other objects the present invention includes a plurality of tubes disposed in a vessel in the flow path of steam introduced into the vessel. Feedwater is introduced into the tubes for passing in a heat exchange relation with the steam to condense at least a portion of the steam and to add heat to the feedwater. An impingement plate is disposed immediately below the inlet in the flow path for deflecting the steam in a direction transverse to the direction of flow of the steam, and at least one vane is disposed in the vessel in the path of the deflected steam for distributing steam more uniformly throughout the vessel.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
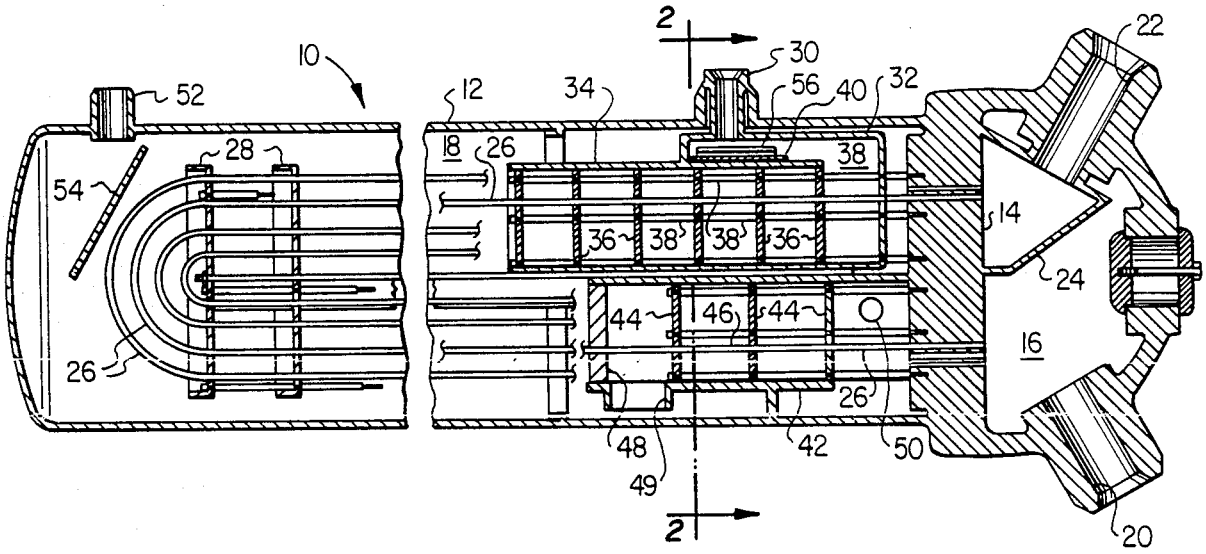
FIG. 1 is a longitudinal, sectional view of the feedwater heater of the present invention.

Referring specifically to FIG. 1 of the drawings, the reference numeral 10 refers in general to the feedwater heater of the present invention. the heater includes an elongated vessel 12 designed for operation with its longitudinal axis extending horizontally. A vertical tube sheet 14 is disposed at one end portion of the vessel 12 and serves as a partition to divide the vessel into two chambers 16 and 18.

A feedwater inlet 20 extends through the lower wall of the vessel and communicates with the chamber 16, and a feedwater outlet 22 extends through the upper wall of the vessel and also communicates with the chamber 16. A plate 24 is disposed in the chamber 16 to isolate the inlet 20 from the outlet 22.

A plurality of U-shaped water tubes 26 are disposed in the chamber 18 and each tube has one end extending into and through the upper portion of the tube sheet 14 and one end extending into and through the lower portion of the tube sheet. Thus, feedwater entering the vessel 10 via the inlet 20 passes through the tube sheet 14 and the lower sections of the tubes 26, and then reverses direction in the tubes and passes through the upper sections of the tubes before passing back through the tube sheet, and the chamber 16 and exiting through the outlet 22. It is noted that portions of the tubes 26 have been omitted from FIG. 1 in the interest of clarity.

A plurality of vertically-extending tube support plates 28 are spaced through the length of the vessel 12 with some also being omitted in the interest of clarity. A plurality of openings extend through each of the plates 28 for receiving and supporting the tubes 26.

A steam inlet 30 extends through the upper wall of the vessel and into the upper portion of the chamber 18, and discharges the steam into a thermal shield, or dome 32 extending in the upper portion of the chamber 18 adjacent the tube sheet 14. The dome 32 extends over the upper portion of a shroud 34 also disposed in the upper portion of the chamber 18. The shroud 34 includes a plurality of spaced baffles 36, each supported in an upright position by a plurality of spacer rods 38 extending between adjacent baffles. An impingement plate 40 rests on the upper wall of the shroud 34 in the path of the steam as it flows into the interior of the dome 32 within the vessel 12 via the inlet 30. The impingement plate 40 can be attached to, or formed integrally with, the upper wall of the shroud 34.

A shroud 42 extends in the lower portion of the chamber 18 and includes a plurality of spaced baffles 44 and spacer rods 46. The shroud 42 extends between the tube sheet 14 and an end seal plate 48 through which the tubes 26 pass. A condensate inlet opening 49 extends through the bottom of the shroud 42 adjacent the end seal plate 48 and allows condensate to enter the shroud 42 interior permitting further heat to be exchanged through the tubes 26. A drains outlet 50 extends through the wall of the vessel 12 in the lower portion of the chamber 18 adjacent the tube sheet 14, allowing the condensate to exit the feedwater heater. A typical drains inlet 52 extends through the wall of the vessel 12 near the end thereof opposite the end through which the feedwater outlet 22 extends. An impingement baffle 54 is disposed in the vessel 12 adjacent the inlet 52.

Figure 2:
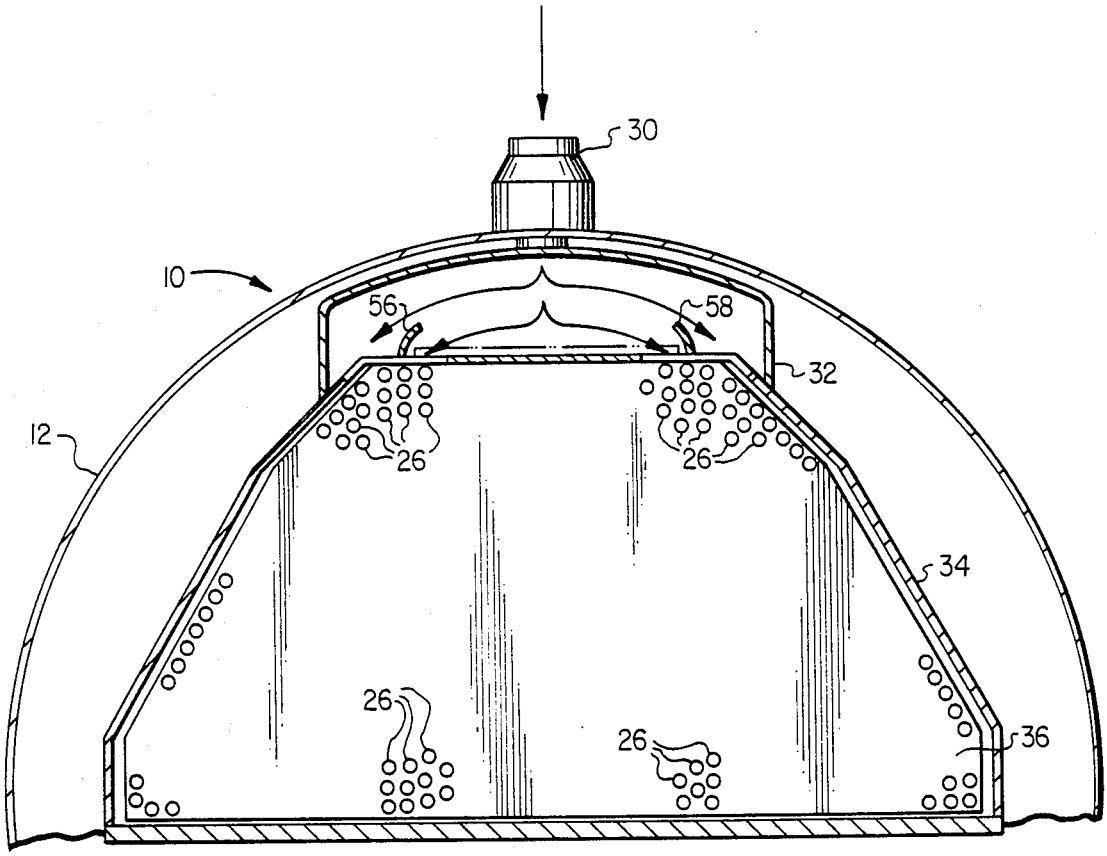
FIG. 2 is an enlarged cross-sectional view taken along the line 2—2 of FIG. 1.

According to a feature of the present invention, a pair of spaced deflector vanes 56 and 58 are secured to the upper surface of the shroud 34 immediately adjacent the opposite sides of the impingement plate 40, as shown in FIG. 2 for the purpose of directing a portion of the steam flow from the inlet 30 over the tubes 26 extending immediately below the vanes. According to the preferred embodiment depicted in the drawings the length of each vane 56 and 58 substantially corresponds to the width of the plate 40 it being understood that the lengths can be extended to project outwardly from the plate within the scope of the invention.

In operation, steam from an external source, such as a steam generator, enters the interior of the vessel 12, via the inlet 30, passes through the dome 32 and impinges upon the impingement plate 40 before spreading out throughout the entire interior of the shroud 34 and the chamber 18. The vanes 56 and 58 serve to direct a predictable portion of the steam flow into the bundle of tubes 26 in an area immediately below the vanes which would otherwise receive less than average flow. Conversely, the vanes 56 and 58 reduce the steam flow where more than average flow would otherwise exist. The vanes 56 and 58 also minimize turbulence/pressure drop and excessive steam velocities and thus aid in a more stable operation with minimum vibration fatigue or erosion/abrasion type tube failures.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A feedwater heater comprising a vessel having an inlet for receiving steam and directing said steam in a flow path through said vessel, a shroud disposed in said vessel for receiving said steam and defining a desuperheater zone in said vessel, a plurality of tubes disposed in said shroud and in said flow path, means for introducing feedwater into said tubes for passing in a heat exchange relation with said steam to condense at least a portion of said steam and to add heat to said feedwater, an impingement plate disposed on the top wall of said shroud and immediately below said inlet for deflecting said steam in a direction transverse to the direction of flow of said steam in said flow path, and two vanes disposed on said top wall of said shroud adjacent the respective opposite sides of said impingement plate and in the path of said deflected steam for distributing steam throughout said tubes.

* * * * *